United States Patent [19]

Nelson

[11] 4,130,162

[45] Dec. 19, 1978

[54] FLOW-THROUGH MULE SHOE SUB

[75] Inventor: Paul M. Nelson, Houston, Tex.

[73] Assignee: Wilson Industries, Inc., Houston, Tex.

[21] Appl. No.: 812,063

[22] Filed: Jul. 1, 1977

[51] Int. Cl.[2] ..... E21B 17/00; E21B 47/00

[52] U.S. Cl. ..... 166/243; 175/45; 175/320; 285/92

[58] Field of Search ..... 166/243, 65 R, 242; 285/90, 92; 151/21 C, 22; 175/4.51, 44, 45, 73, 75, 320

[56] References Cited

U.S. PATENT DOCUMENTS

| | | | |
|---|---|---|---|
| 2,197,227 | 4/1940 | Strength | 175/75 |
| 3,052,309 | 9/1962 | Eastman | 175/45 |
| 3,072,070 | 1/1963 | Marcell | 285/92 |
| 3,765,494 | 10/1973 | Kielman Jr. | 175/320 |

*Primary Examiner*—Stephen J. Novosad
*Attorney, Agent, or Firm*—Arnold, White & Durkee

[57] ABSTRACT

A sleeve for supporting a radially inwardly extending key disposed within the interior of a drilling sub is characterized by a substantially cylindrical body member having a plurality of ribs extending either radially inwardly or radially outwardly therefrom to define a plurality of fluid conducting channels. A plurality of threads is provided on the radially outer surface of the sleeve adjacent the first axial end thereof. A radially extending notch divides the threads into a first and second set of threads. With the first and second set of threads engaged with a plurality of threads disposed on the interior of the sub, a threaded bolt is disposed in an axially extending bore provided within the sleeve, to thereby lock the sleeve in position within the sub.

4 Claims, 8 Drawing Figures

FIG. 3
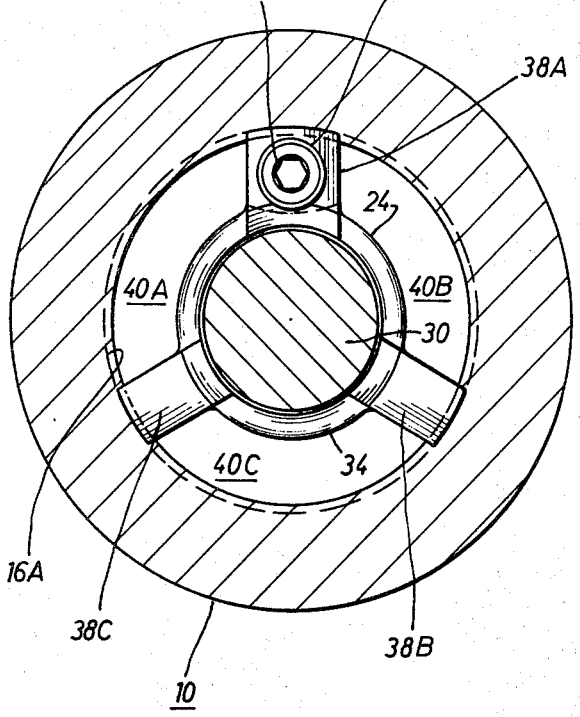
FIG. 4
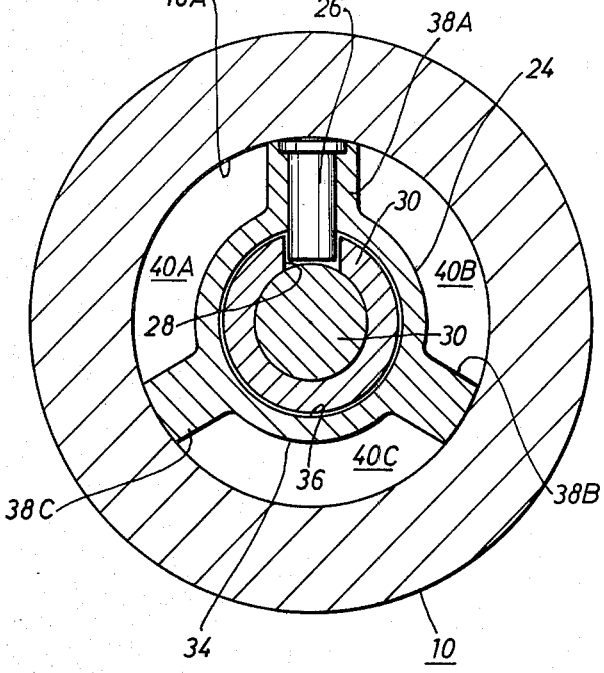
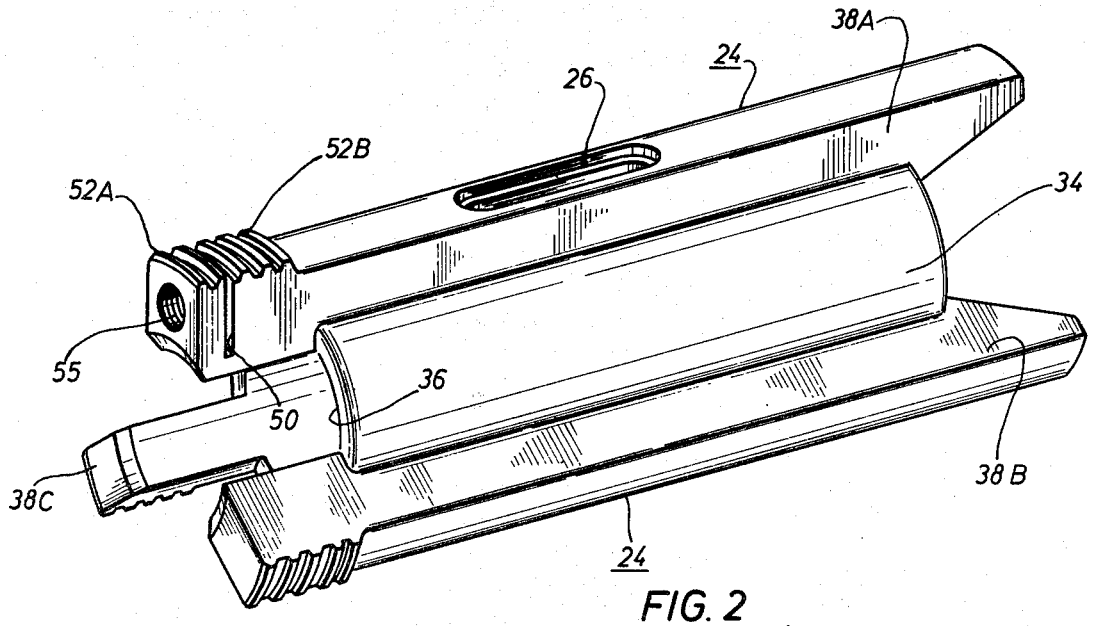
FIG. 2

FIG.7
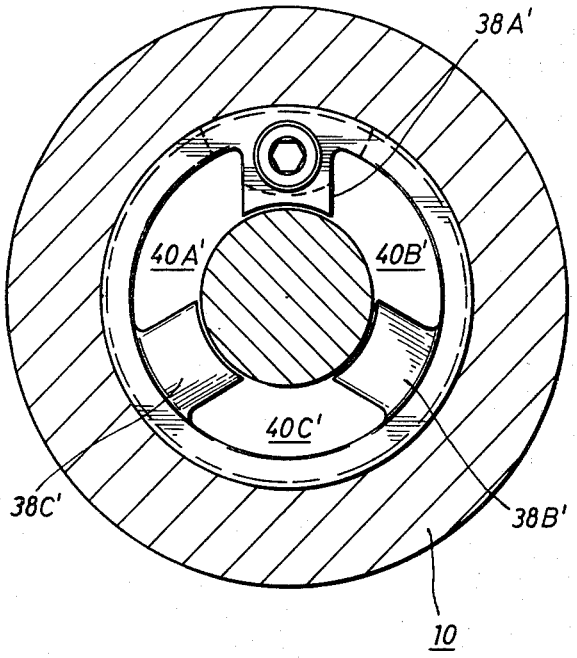
FIG.8
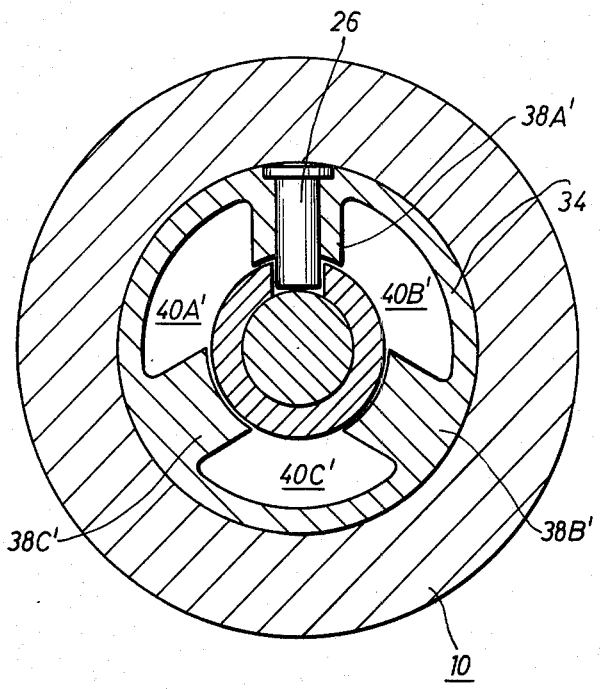
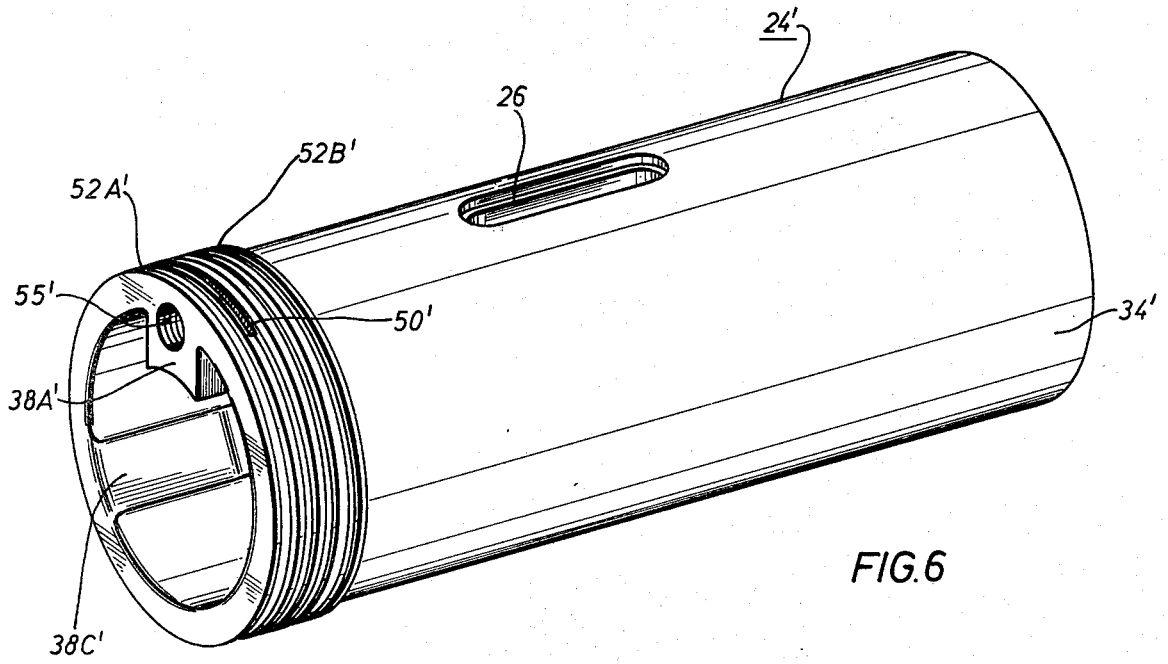
FIG.6

FLOW-THROUGH MULE SHOE SUB

BACKGROUND OF THE INVENTION

1. Field of the Invention

This invention relates to apparatus for supporting a key used to orient a directional drilling assembly, and in particular, to a sleeve having fluid conducting channels therein adapted to permit fluid flow therethrough when the directional drilling assembly is engaged with the key.

2. Description of the Prior Art

In order to ascertain the angular orientation of a drill bit, or the like, it is common practice in the art to dispose a radially inwardly extending key member within a bore extending through the drill string to which the bit is attached. The key is usually in a predetermined angular orientation with respect to the drill bit or member whose orientation it is desired to ascertain.

Periodically, during the drilling or generation of a well bore, a directional drilling assembly may be pumped-down or lowered on a wire string into the bore extending through the running string. The lowermost constituent element of the directional drilling assembly is usually a mule shoe arrangement having an axially extending slot communicating at its lower end with a camming surface. Abutting engagement of the key with the camming surface acts to rotate the directional drilling assembly so as to permit the slot therein to receive the key. When the slot and key are engaged, the directional ascertaining element of the assembly may accurately plot or record the orientation at which the key, and therefore the drill bit, are disposed relative to a predetermined datum.

However, with the mule shoe of the directional drilling assembly engaged with the key, the cross sectional area of the bore through the interior of the running string is blocked. Accordingly, circulation of drilling fluid therethrough is prohibited.

U.S. Pat. No. 3,765,494, issued to Kielman, provides a circulating sleeve having a shoulder at the lower axial portion thereof adapted to abut against a shoulder disposed on the interior of a sub connected within a drill string. To prevent rotation of the sleeve with respect to the sub, a radially extending locking key extends through the sub and into the sleeve. Suitable cutouts are provided on the sleeve to define flow channels between the interior of the sub and the exterior of the sleeve. Thus, while the key is engaged into the slot in the mule shoe, fluid flow is permitted in the channels defined. In order to prevent the leakage of fluid from the defined flow channels to the exterior of the sub through the locking keyway, it is necessary to provide seals or the like about the key. Of course, the structural integrity of the sub may be weakened due to the provision of the radially extending bore adapted to receive the locking key therein.

SUMMARY OF THE INVENTION

The invention relates to a sleeve for supporting a radially inwardly extending key on the interior of a sub connected within a drill string.

The sub has a bore of a first and a second diametrical dimension extending therethrough, the first dimension being greater than the second dimension. A plurality of screw threads are provided on the interior of the enlarged diametrical portion. The sleeve includes a cylindrical portion having, in a first embodiment, a plurality of radially outwardly extending ribs thereon. The ribs have a first and a second set of screw threads on the circumference thereof, the sets of threads being defined by a radial notch cut into one of the ribs. The threads on the sleeve are engageable with the threads in the sub to thereby support the sleeve in position therein. An axially extending opening is provided in the rib having the notch therein, the opening adapted to receive a bolt, which when engaged within the opening, places the portion of the sleeve axially below the notch in tension and axially above notch in compression to thereby lock the sleeve with respect to the sub.

In an alternate embodiment, the ribs extend radially inwardly with respect to the sleeve, and the sleeve is provided with a plurality of screw threads circumferentially thereon. A notch is cut radially into the sleeve to divide threads into a first and a second set thereof. An axially extending opening to provided in the sleeve adjacent to the notch. The opening receives a bolt therein which, when engaged, places the portion of the sleeve below the notch in tension and the portion of the sleeve above the notch in compression to thereby lock the sleeve with respect to the sub.

BRIEF DESCRIPTION OF THE DRAWINGS

This invention will be more fully understood from the following detailed description thereof, taken in connection with the accompanying drawings, which form a part of this application, and in which:

FIG. 2 is a perspective view of a sleeve used in the mule shoe sub shown in FIG. 1;

FIGS. 3 and 4 are each sectional views taken along section lines 2—2 and 3—3 of FIG. 1;

FIG. 6 is a perspective view of a sleeve used in the mule shoe sub shown in FIG. 5;

FIGS. 7 and 8 are sectional views respectively taken along section lines 5—5 and 6—6 in FIG. 5.

DESCRIPTION OF THE PREFERRED EMBODIMENT

Figure 1:
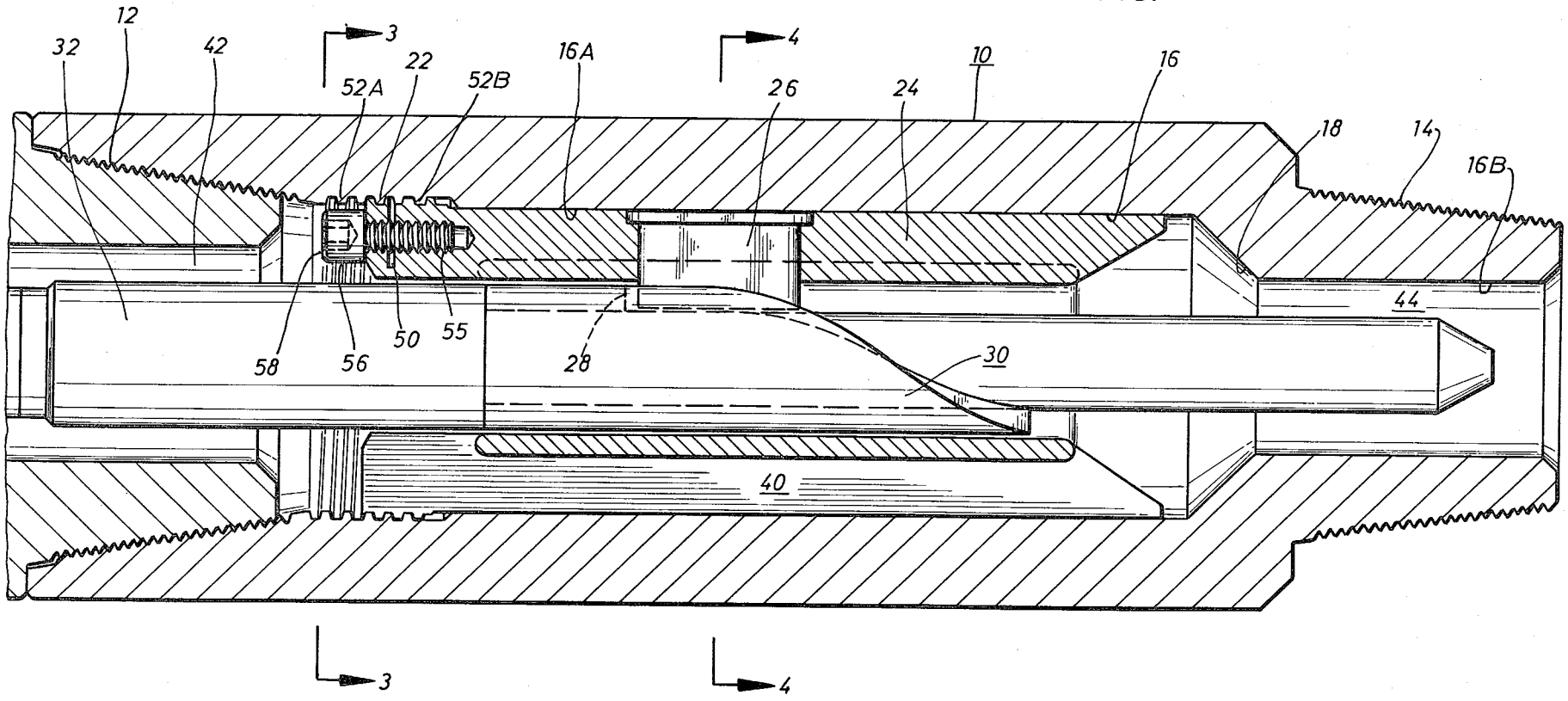
FIG. 1 is an elevational view, entirely in section, of a flow-through mule shoe sub embodying the teachings of this invention.

Throughout the following description, similar reference numerals refer to similar elements in all figures of the drawings.

Referring to FIGS. 1 through 4, a first embodiment of a flow-through mule shoe sub embodying the teachings of this invention is illustrated. The mule shoe sub generally indicated by reference numeral 10 is a substantially cylindrical member having axially upper internal threads 12 and axially lower external threads 14 provided thereon. The threads 12 and 14 are respectively connected to axially adjacent elements defining a drill string. The sub 10 has an internal bore 16 extending therethrough, the bore exhibiting a first portion 16A having predetermined a first, enlarged diametrical dimension and a second portion 16B having a reduced diametrical dimension connected by a transition region 18. A plurality of internal threads 22 is disposed adjacent the upper axial end of the interior of the sub 10 in the region of enlarged diameter region 16A for a purpose which is made more clear herein.

As is discussed above, in directional drilling work, it is of utmost importance to accurately ascertain the orientation at which a drill bit (affixed either directly or indirectly to the lower end of the sub 10) is disposed. For this purpose, it is common in the art to provide a radially extending key member in a predetermined relationship with the drill bit or other member whose orientation it is desired to ascertain.

Disposed within the enlarged diametrical portion 16A of the sub 10 is a sleeve 24 which supports a radially inwardly extending key member 26. The key 26 projects radially inwardly into the bore 16 extending through the sub. As is appreciated by those skilled in the art, the key 26 is adapted to be received within a slot provided on the exterior surface of a mule shoe member generally indicated by reference numeral 30. The mule shoe 30 is usually the axially lowermost element in a directional ascertaining assembly 32 which is either pumped-down or lowered into the bore 16 through the sub 10 on a wire line or the like. The assembly 32 has apparatus disposed therewithin which provides an indication of the orientation of the key 26 (and, therefore, the drill bit attached to the sub 10) when the key 26 is engaged within the slot 28.

When the mule shoe 30 is engaged with the key 26, it may be appreciated that substantially the entire cross-sectional area of the bore 16 extending through the sub 10 is blocked, thus preventing the passage of well drilling fluid therethrough. To alleviate this condition the sleeve 24 is adapted to permit well drilling fluid to pass through the bore 16 even when the mule shoe 30 is engaged with the key 26. The sleeve 24, in the embodiment of FIGS. 1 through 4, includes a substantially cylindrical portion 34 having a bore 36 therethrough. The sleeve 24 is disposed within the enlarged diametrical portion 16A of the sub 10, with the bore 36 substantially registering with the reduced diametrical portion 16B of the bore 16. A plurality of radially outwardly extending ribs 38 extend longitudinally along the entire length of the cylindrical portion 34 of the sleeve 24. The ribs 38 project outwardly beyond the basic thickness of the cylindrical portion 34 and, in cooperation with the outer surface of the sleeve 24 and the inner surface of the sub 10 define axially extending channels 40 which permit well drilling fluid to flow from the region 42 axially upstream of the sleeve 24, through the channels 40 and into the region 44 of the bore 16 disposed below the lower axial end of the sleeve 24. The effective cross-sectional area of the channels 40 is substantially equal to the cross sectional area of the region 42 of the bore above the sub 10 and the cross sectional area of the region 44 defined by the reduced diametrical portion 16B of the bore 16. Thus, little or no pressure drop across the sub 10 will be experienced.

Disposed circumferentially about the exterior of the ribs 38 adjacent the upper axial end of the sleeve 24 is a plurality of screw threads. The threads on one rib 38A are divided by a radially extending notch 50 into an axially upper set 52A of threads and an axially lower set 52B of threads. A substantially axially extending threaded bore 55 is provided from the upper axial end of the rib 38A having the notch 50 therein. The opening 55 is adapted to receive an elongated threaded bolt 56 having an appropriately configured head 58 thereon.

In operation, before the sub 10 is threadedly engaged within the drill string of which it is a constituent element, the sleeve 24 is axially inserted within the diametrically enlarged portion 16A of the bore 16 of the sub 10 by the threaded engagement of the threads 52 on the ribs 38 of the sleeve 24 with the threads 22 provided on the interior of the sub 10. Any predetermined degree of engagement between the threads 22 and 52 may be provided.

To secure the sleeve 24 in position within the enlarged portion 16A of the bore of the sub 10, the bolt 56 is threadedly engaged within the bore 55 in the rib 38A by an appropriate tool adapted to be inserted into the opening provided in the head 58 of the bolt 56. Axially threading the bolt 56 into the bore 55 in rib 38 places the portion of the sleeve 24 axially below the notch 50 in tension and disposes the portion of the sleeve 24 above the notch in compression to thereby lock the sleeve 24 in position within the interior of the sub 10. Therefore, when the key 26 is received within the slot 28 provided in the mule shoe 30, the channels 40 permit communication between the regions 42 and 44 in the interior of the drill string respectively upstring and downstring of the engaged key and mule shoe.

Figure 5:
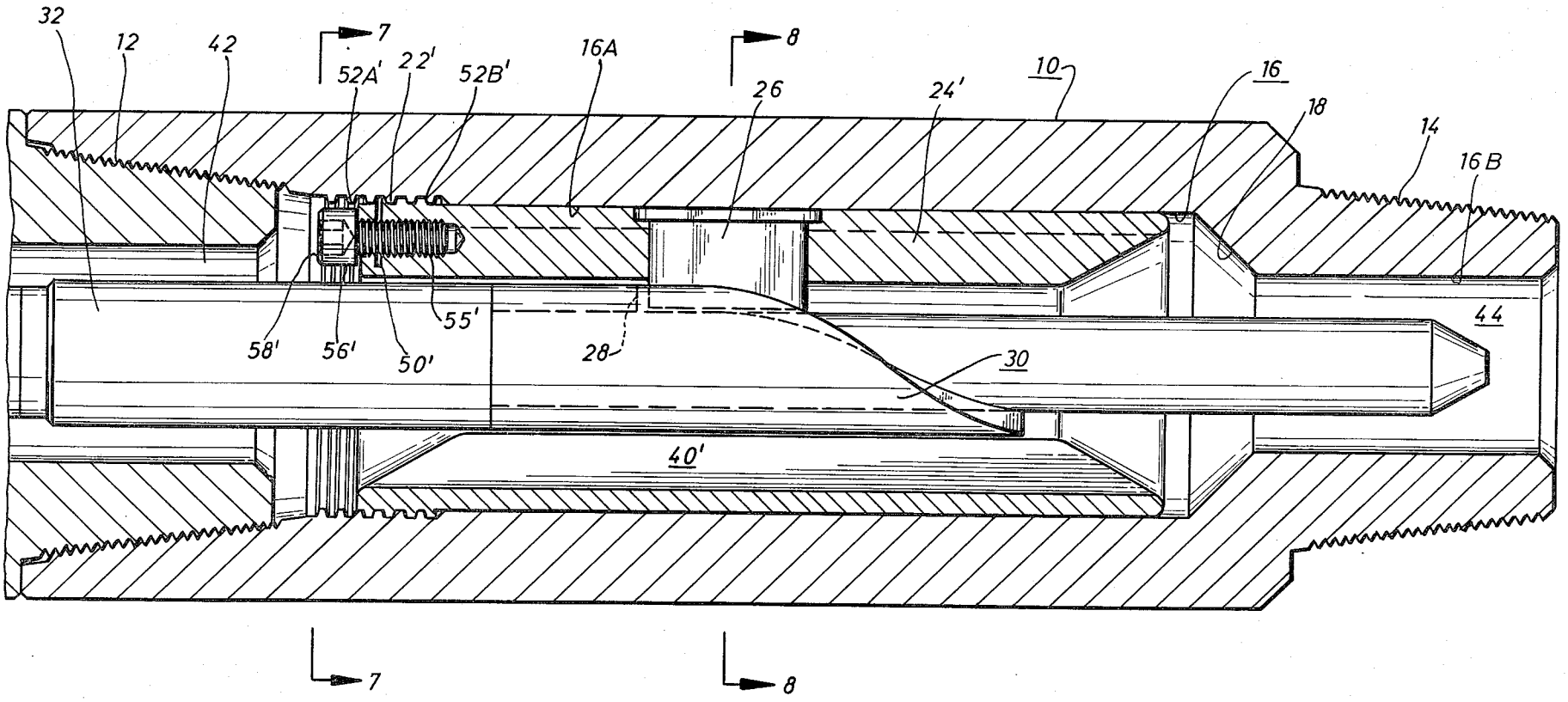
FIG. 5 is an elevation view, entirely in section, of another embodiment of a flow-through mule shoe sub embodying the teachings of this invention.

Referring now to FIGS. 5 through 8, a second embodiment of the flow-through mule shoe sub embodying the teachings of this invention is illustrated. In FIGS. 5 through 8, it is seen that the sleeve 24' again includes a basic cylindrical portion 34' but disposes radially inwardly extending ribs 38'. The ribs 38' define axially extending flow channels 40' by the cooperative association of the ribs, the interior surface of the sleeve 24' and the exterior surface of the mule shoe assembly 30. As is the case with the embodiment shown in FIGS. 1 through 4, a plurality of threads 52' is disposed about the exterior of the cylindrical portion 34' of the sleeve 24' adjacent the first, upper axially end thereof. The engagement of the threads 52' with the threads 22 disposed on the interior of the sub 10 supports the sleeve 24 within the enlarged diametrical portion 16A of the bore extending therethrough.

A radially extending notch 50' defines a first and second set of threads, respectively numbered 52A' and 52B', within the plurality 22' of threads disposed on the exterior of the cylindrical portion 34' of the sleeve 24'. An axially extending threaded bore opening 55' is provided within the rib 38A' of the sleeve 24' adjacent to the portion thereof in which the radial notch 50' is disposed.

In operation, the sleeve 24' may be threadedly engaged in a supporting position within the enlarged diametrical portion 16A of the sub 10. To lock the sleeve 24' in position, a bolt 56' is threadedly engaged within the bore 55' provided in the rib 38A' of the sleeve 24'. The bolt 56' has an opening 58' on the head thereof which is adapted to receive a suitable tool whereby the bolt 56' may be threadedly engaged into the bore 55'. With the bolt 56' so engaged, that portion of the sleeve below the radially notch 54' is placed in tension while that portion of the sleeve 24' above the radial notch 54' is compressed. In this manner, the sleeve 24' is locked into position within the enlarged diametrical portion 16A of the bore through the sub 10.

In both embodiments of the invention above described, it may be appreciated that the structural integrity of the sub 10 is maintained and no radially extending locking keys or the like are provided in order to prevent rotation of the sleeve with respect to the sub 10. Thus, no seals or the like are required in order to prevent leakage of drilling fluid from the interior of the sub 10 to the exterior thereto as is the case with the prior art.

Having described preferred embodiments of the invention, those having skill in the art may provide modifications thereto in view of the teachings disclosed herein. It is understood that those modification are within the contemplation of this invention as defined in the appended claims.

What is claimed is:

1. A sleeve for supporting a radially inwardly extending key comprising:

a substantially cylindrical member having a predetermined thickness dimension associated therewith and a first and a second axial end thereon;

a plurality of radially outwardly extending ribs disposed on said cylindrical member;

a plurality of screw threads extending circumferentially about the axial surface of said ribs adjacent said first axial end of said cylindrical member; and, one of said ribs having an axially extending opening and a substantially radially extending notch disposed therein, said notch dividing said plurality of threads into a first and a second set of threads.

2. Apparatus according to claim 1 further comprising an axially extending bolt receivable within said axially extending opening such that threaded engagement of said bolt within said opening places said portion of said sleeve below said notch in tension and said portion of said sleeve above said notch in compression.

3. A sleeve for supporting a radially inwardly extending key comprising:

a substantially cylindrical member having a predetermined thickness dimension associated therewith and a first and a second axial end thereon;

a plurality of radially inwardly extending ribs disposed on said cylindrical member;

a plurality of screw threads extending circumferentially about the exterior surface of said cylindrical member adjacent said first axial end thereof; and, one of said ribs having an axially extending opening and a substantially radially extending notch disposed therein, said notch dividing said plurality of threads into a first and a second set of threads.

4. Apparatus according to claim 3 further comprising an axially extending bolt receivable within said axially extending opening such that threaded engagement of said bolt within said opening places said portion of said sleeve below said notch in tension and said portion of said sleeve above said notch in compression.

* * * * *